US011210914B2

(12) United States Patent
Harvey

(10) Patent No.: US 11,210,914 B2
(45) Date of Patent: Dec. 28, 2021

(54) LOOP CONDUCTOR SECURITY ALARM SYSTEM

(71) Applicant: Steve Harvey, Austin, TX (US)

(72) Inventor: Steve Harvey, Austin, TX (US)

( * ) Notice: Subject to any disclaimer, the term of this patent is extended or adjusted under 35 U.S.C. 154(b) by 0 days.

(21) Appl. No.: 17/098,424

(22) Filed: Nov. 15, 2020

(65) Prior Publication Data

US 2021/0209911 A1 Jul. 8, 2021

Related U.S. Application Data

(60) Provisional application No. 62/936,137, filed on Nov. 15, 2019.

(51) Int. Cl.
*G08B 13/22* (2006.01)
*G08B 3/10* (2006.01)

(52) U.S. Cl.
CPC ..... *G08B 13/22* (2013.01); *G08B 3/10* (2013.01)

(58) Field of Classification Search
CPC ..... G08B 13/22
See application file for complete search history.

(56) References Cited

U.S. PATENT DOCUMENTS 5,406,263 A * 4/1995 Tuttle ..... G06K 19/07798 340/541
5,646,592 A * 7/1997 Tuttle ..... G06K 19/07798 340/541
5,831,531 A * 11/1998 Tuttle ..... G08B 13/1445 340/568.2
7,064,667 B2 * 6/2006 Sosna ..... G08B 13/149 340/541
7,616,116 B2 * 11/2009 Ehrensvard ..... G08B 13/1445 340/541
RE42,777 E * 10/2011 Tuttle ..... G08B 13/1445 340/572.1
RE43,415 E * 5/2012 Tuttle ..... G06K 19/07798 340/572.1
2005/0231365 A1 * 10/2005 Tester ..... G06K 19/07798 340/568.1

* cited by examiner

*Primary Examiner* — Travis R Hunnings
(74) *Attorney, Agent, or Firm* — Dickinson Wright PLLC

(57) ABSTRACT

The present invention provides a loop conductor based alarm and security system to secure a number of valuable objects together in such a manner that if an attempt to remove any one object in the linked group is made, an alarm will sound (locally and remotely, if desired). The system uses electronic controllers that monitor the condition of an electrically conductive loop path that has been established around and/or through the valuable objects, connecting them to a generally immovable object such as a vehicle or trailer. A unique "lasso" termination element is used in connection with a standard electrical extension cord or a standard trailer plug connector wiring harness. A loop conductor electronic controller is used in each case. The electronic controller may be connected to existing security systems for the vehicle as well as to ancillary components such as sirens, wireless telemetry devices, and other vehicle security system components.

8 Claims, 5 Drawing Sheets

LOOP CONDUCTOR SECURITY ALARM SYSTEM

CROSS REFERENCES TO RELATED APPLICATIONS

This application claims the benefit under Title 35 United States Code § 119(e) of U.S. Provisional Patent Application Ser. No.: 62/936,137; Filed: Nov. 15, 2019; the full disclosure of which is incorporated herein by reference.

BACKGROUND OF THE INVENTION

Field of the Invention

The present invention relates generally to alarm systems and security systems. The present invention relates more specifically to an alarm system for securing objects together with a loop conductor element. The present invention relates more specifically to the terminal element for a loop conductor alarm system.

Description of the Related Art

Electrical conductor based alarm systems are known in the art. Examples of such systems include: U.S. Pat. Nos. 6,337,633; 4,132,987; 4,746,909; 3,919,705; 3,425,050; 5,418,521; Application Publication No. US 2013147625; Application Publication No. US 2005040948; Application Publication No. US 2019122510; and Application Publication No. US 2016042619; the full disclosures of which are incorporated herein by reference.

The present invention improves upon the above systems and methods and provides solutions to the problems associated with overly complex and expensive alarm and security systems. The present invention provides a termination device and associated system components that are easy to use and rugged in their performance. The present invention provides components that may be integrated into existing vehicle alarm and automatic locking systems.

SUMMARY OF THE INVENTION

The present invention provides a loop conductor based alarm and security system to secure a number of valuable objects together in such a manner that if an attempt to remove any one object in the linked group is made, an alarm will sound (locally and remotely, if desired). The system uses electronic controllers that monitor the condition of an electrically conductive loop path that has been established around and/or through the valuable objects, connecting them to a generally immovable object such as a vehicle or trailer.

The system is structured to operate with at least two alternate interconnection methods, a first with a standard electrical extension cord and a second with a standard trailer connection wire tail. A unique "lasso" termination element is used in each case. A common loop conductor electronic controller is also used in each case. The electronic controller may be connected to existing power lock and security systems for the vehicle as well as to ancillary components such as sirens, wireless telemetry devices, and other vehicle security system components.

DETAILED DESCRIPTION OF THE PREFERRED EMBODIMENTS

Figure 1A:
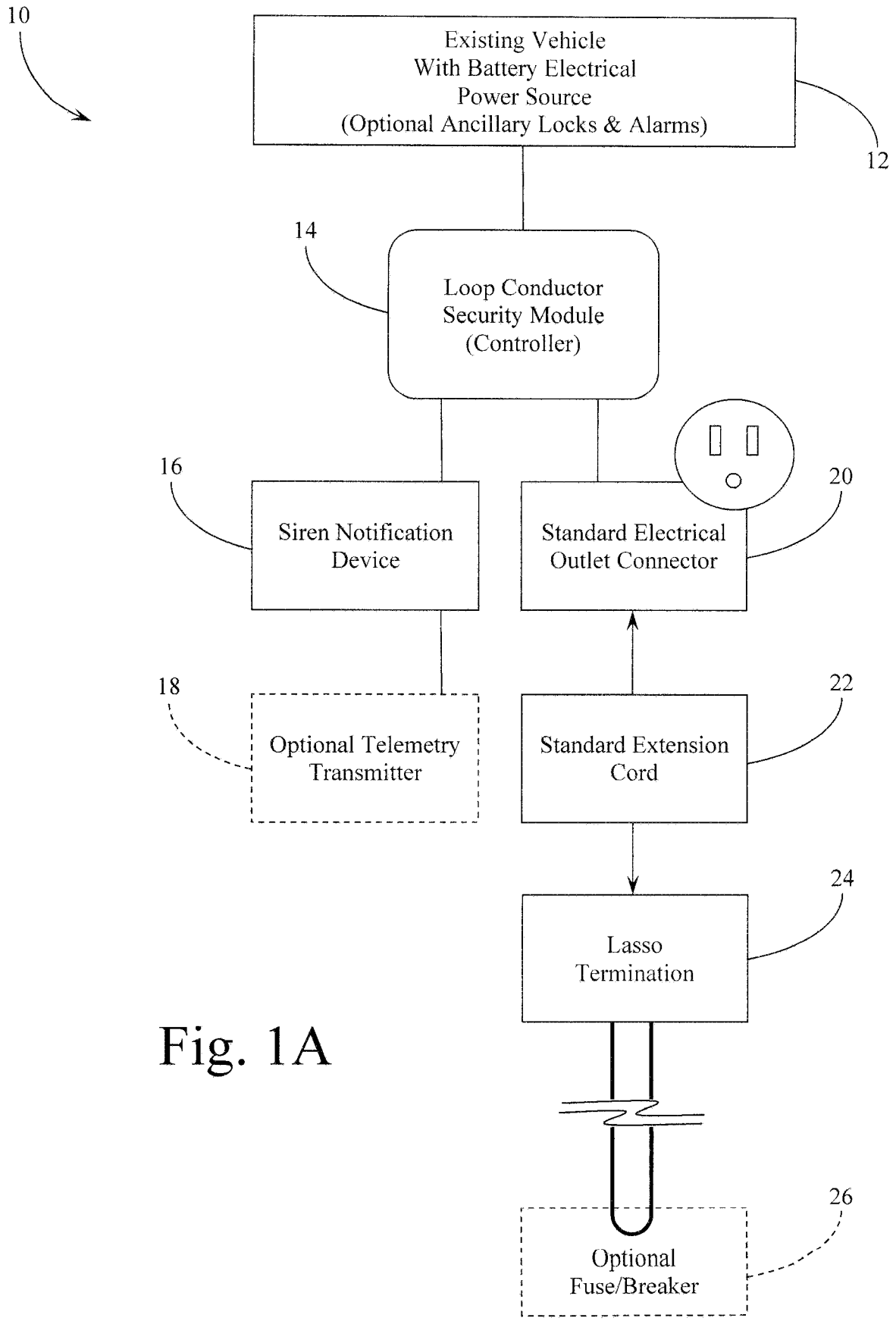
FIG. 1A is a schematic block diagram showing the basic components of the system of the present invention implemented in connection with a standard electrical outlet connector and a standard extension cord as an intermediate connector.
Figure 1B:
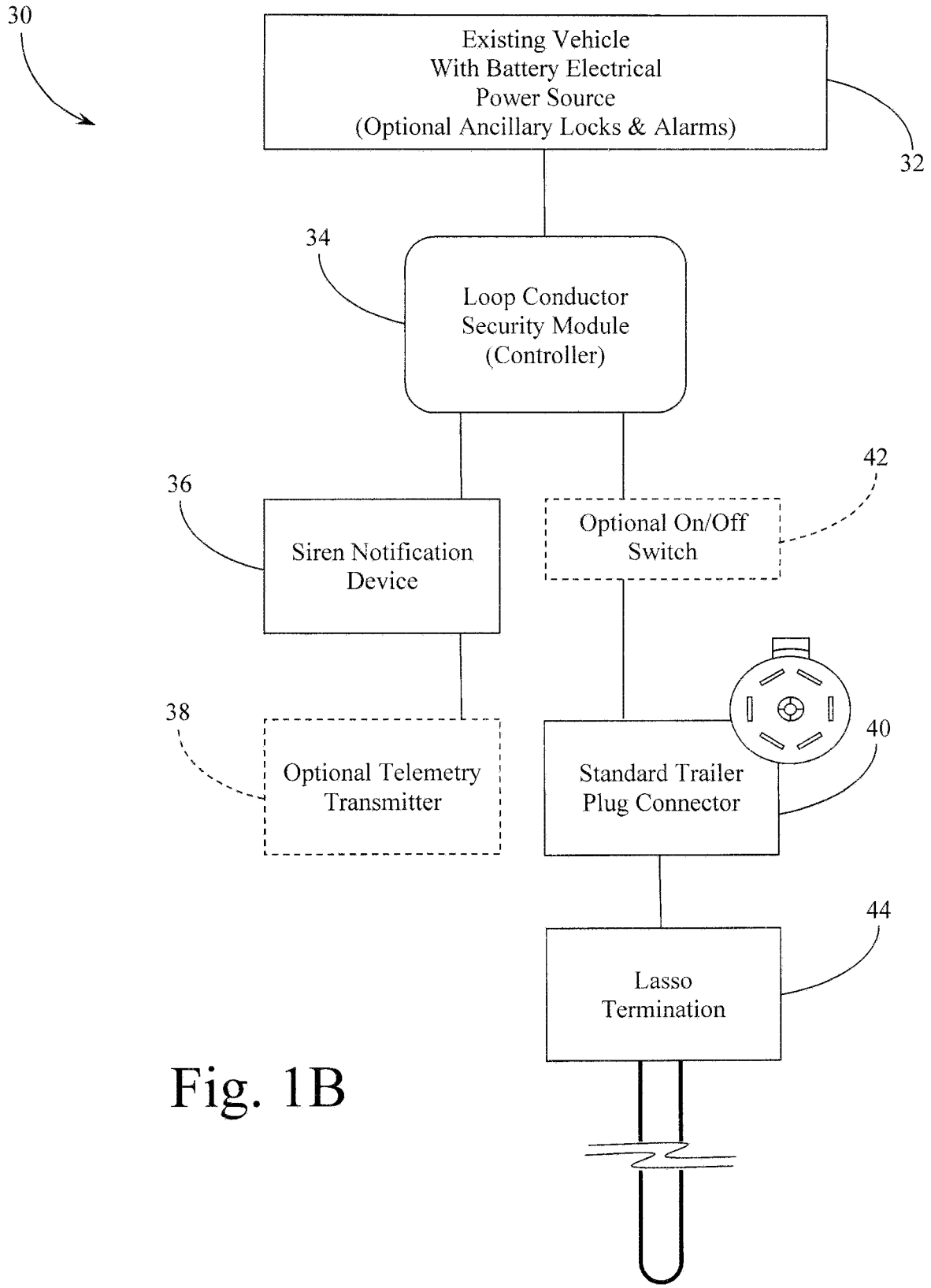
FIG. 1B is a schematic block diagram showing the basic components of the system of the present invention implemented in connection with a standard trailer plug connector and a standard trailer wiring harness tail as an intermediate connector.

Reference is made first to FIGS. 1A & 1B for a description of the basic arrangement and interconnection of components associated with the systems of the present invention. FIGS. 1A & 1B show the two basic implementations of the standalone systems incorporating the elements of the present invention. FIG. 1A is a schematic block diagram showing the basic components of the system of the present invention implemented in connection with a standard electrical outlet connector and a standard extension cord as an intermediate connector. System 10 shown in FIG. 1A includes the existing vehicle components 12 that include a battery electrical power source and any existing available ancillary locks and alarms on the vehicle. Security module 14 is the controller component of the system of the present invention and provides the interface between the system and the vehicle. There are two essential electronic lines that extend from security module 14, a first is an output signal line for driving alarm devices and a second is an input signal line making up the sensor line of the present invention. The output signal line is made up of a local siren notification device 16 driven by security module 14 and an optional telemetry transmitter 18 for remote alert notification functionality.

The sensor line side of the system extending from security module 14 includes a standard electrical outlet connector 20 (with preferable outlet configuration shown). Inserted into outlet connector 20 is the proximal end of a standard extension cord 22 which is then looped or fed through the objects being protected before being connected on the distal end of the cord 22 to the lasso termination device 24. The lasso termination device 24 may include an optional fuse/breaker 26 to protect against the accidental use of the cord 22 and device 24 in an ordinary electrical power outlet.

FIG. 1B is a schematic block diagram showing the basic components of the system of the present invention implemented in connection with a standard trailer plug connector and a standard trailer wiring harness tail as an intermediate connector. Optional components (telemetry transmitter, fused termination element, and in-line on/off switch) are also disclosed. System 30 shown in FIG. 1B includes the existing vehicle components 32 that include a battery electrical power source and any existing available ancillary locks and alarms on the vehicle. Security module 34 is once again the controller component of the system of the present invention and provides the interface between the system and the vehicle. As with the first embodiment described above, there are two essential electronic lines that extend from security module 34, a first is an output signal line for driving alarm devices and a second is an input signal line making up the sensor line of the present invention. The output signal line is again made up of a local siren notification device 36 driven by security module 34 and an optional telemetry transmitter 38 for remote alert notification functionality.

The sensor line side of the system shown in FIG. 1B extends from security module 34 includes a standard trailer plug connector 40 (with preferable outlet configuration shown). Optionally intermediate between trailer plug connector 40 and security module 34 is an on/off switch 42 for activating or deactivating the system (typically from within the vehicle). Inserted into outlet connector 40 is the proximal end of a standard trailer plug connector and a standard trailer wiring harness tail that serves as the intermediate conductor which is then looped or fed through the objects being protected before being connected on the distal end to the lasso termination device 44. The typically loose end of the lasso termination device 44 in this embodiment is less likely to require fused or breaker protection due to the lower DC voltages associated with trailer wiring systems.

Figure 2:
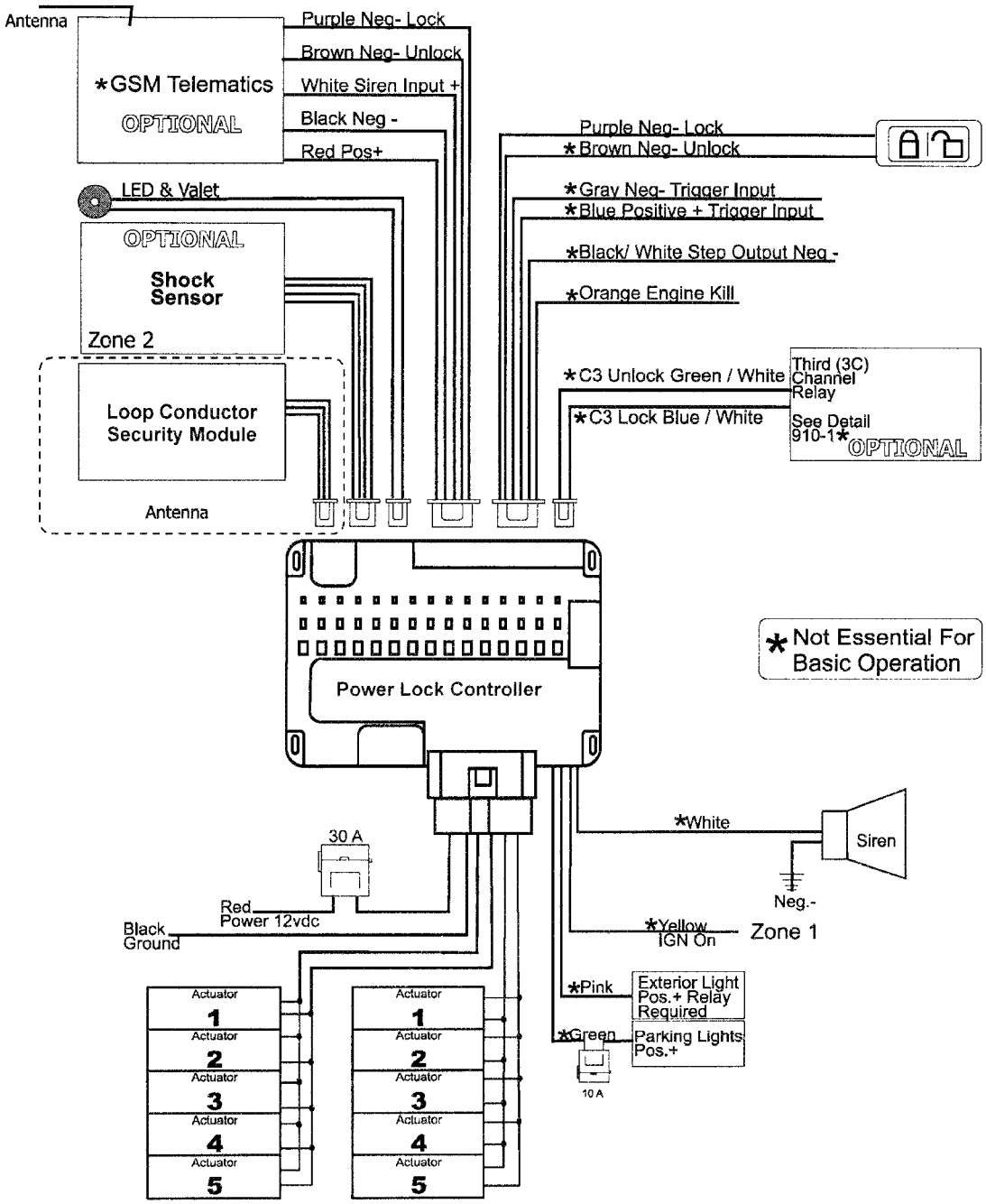
FIG. 2 is a schematic diagram showing the system components of the present invention incorporated into an existing vehicle power lock control and vehicle security system.

Reference is next made to FIG. 2 which is a schematic diagram showing the electronic system components of the present invention incorporated into an existing vehicle power lock control and vehicle security system. As the process of setting the security system of the vehicle preferably includes setting the loop conductor security system at the same time, the devices and components of the present invention may preferably be incorporated into an existing vehicle power lock and security alarm system as shown in FIG. 2. While there are a variety of existing vehicle power lock controller systems and a wide range of vehicle alarm systems, the arrangement shown in FIG. 2 is but one example of the manner in which the loop conductor security system of the present invention may be incorporated into the existing components on an installed vehicle alarm and power lock system.

Figure 3A:
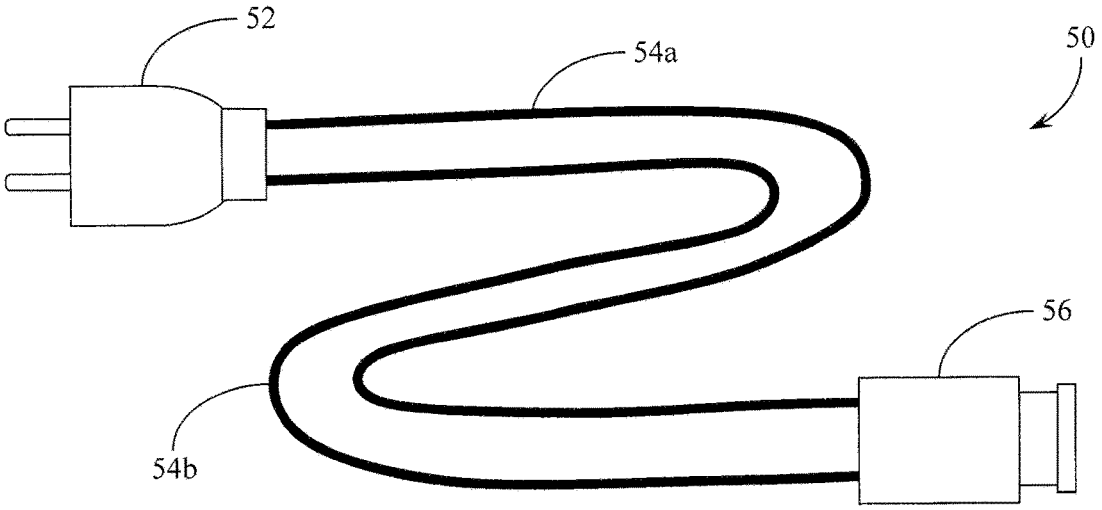
FIG. 3A is a side view of the termination "lasso" component of the system of the present invention shown extending from the standard plug (110 V electrical type plug in this example) through two parallel parts of a loop conductor, to a fused terminal end component.
Figure 3B:
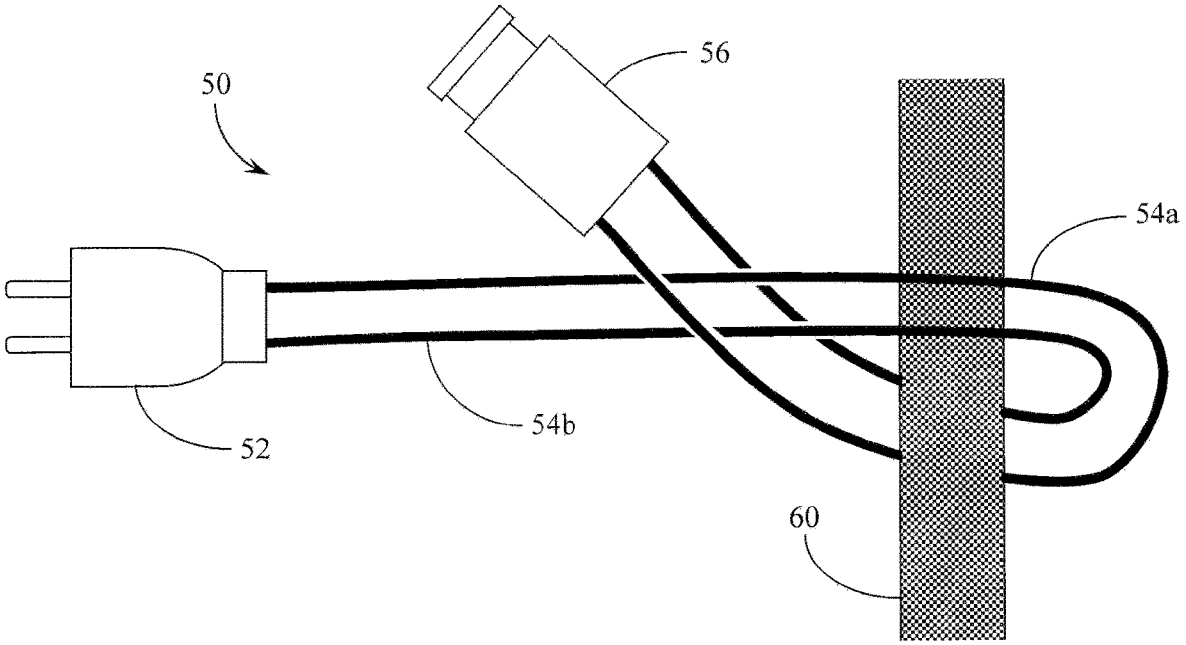
FIG. 3B is a side view of the termination "lasso" component of the system of the present invention shown extending around a closed element of the object being secured back through itself to form an attachment that cannot be removed without breaking the conductive path.

FIGS. 3A & 3B provide additional detail regarding the structure and use of the "lasso" termination element of the present invention. FIG. 3A is a side plan view of the termination "lasso" component 50 of the system of the present invention shown extending from the standard plug 52 (110 V electrical type plug in this example) through two parallel parts 54*a* & 54*b* of a loop conductor, to a fused terminal end component 56. The length of the intermediate insulated wires is best determined by the specific use of the system and how large the objects being protected are. As can be understood by reference to the previously described drawing figures, it is necessary only to "lasso" a secure (close ended) portion of the object being protected. The ability to lasso the "end object"' in a chain of objects being protected may be more specific than the simple manner of threading the extension cord through each of a number of intermediate objects. In any event, the length of the insulated wires 54*a* & 54*b* shown in FIG. 3A may preferably be any length from as little as six inches to three feet or more.

FIG. 3B is a side view of the termination "lasso" component 50 of the system of the present invention shown extending around a closed element 60 of the object being secured back through itself to form an attachment that cannot be removed without breaking the established conductive path established by conductors 54*a* & 54*b*. Once plug 52 is "plugged-in" after having been threaded through the intermediate objects and lassoed to the terminal object, the alarm system may be activated and any breaking of the conductive path by cutting either or both of the conductors 54*a* & 54*b*, or by removing the connector 52, will trigger the alarm (local and optionally remote) as described above.

Figure 4:
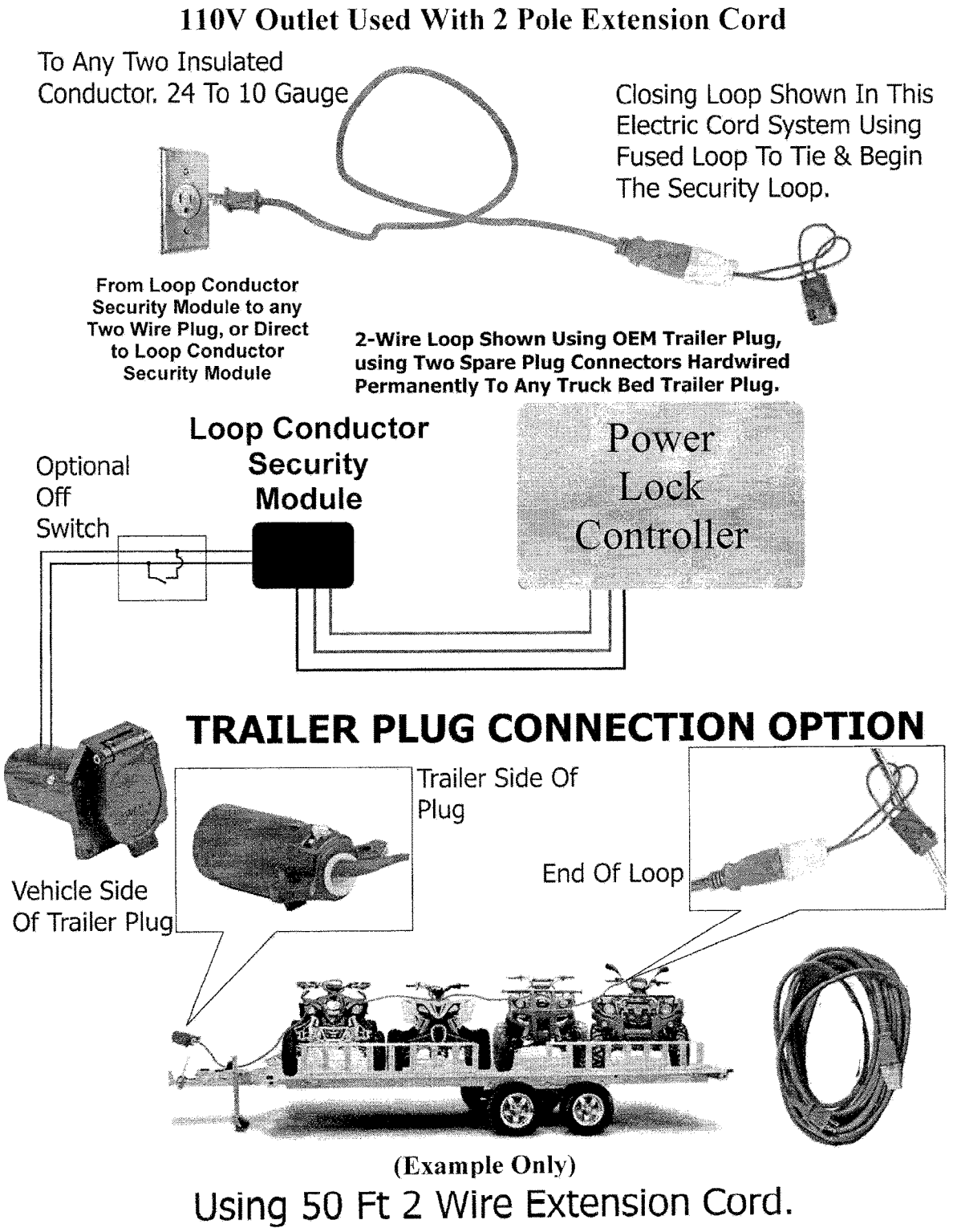
FIG. 4 is a schematic perspective view of the two basic implementations of the present invention, the first with an extension cord and the second with a trailer plug.

FIG. 4 is a visual schematic view of the two basic implementations of the present invention shown in block diagram form in FIGS. 1A & 1B, the first with an extension cord and the second with a trailer plug. In this diagram it can be seen how the user may implement standard elements (such as standard electrical extension cords) to best accommodate the specific use of the system. Both the standard extension cord version of the invention and the standard trailer plug connection version are disclosed.

The "lasso" utilized in the first example of application is preferably a two-prong 110 V male plug. The "lasso" is the last connection to any length or quantity of electric cords (in the first application). As the name implies, it is a loop of wire, having as its purpose to complete a closed circuit. It is this element that is connected to a final object that is being secured before being plugged into the extension cord. The lasso is tied in a "choker knot" configuration then plugged into loop conductor security system. This enables the overall system to be used with any common electrical extension cord.

The lasso is preferably made of a male plug with varying lengths of insulated wire. The plug preferably has a thermal coupler (optional fuse/breaker 26 shown in FIG. 1A) in the circuit should it accidentally be plugged into high voltage. It cannot short as the thermal coupler fuses and resets when high voltage is removed. If a common standard female 110 V outlet is used as the origin of the loop conductor security circuit, should anyone accidentally plug into it expecting it to function as a high voltage AC outlet, the result will lead to disappointment but no harm will come of its accidental use in this manner.

The "lasso" utilized in the second preferred application is quite similar to the first except for the proximal connector (structured as a trailer plug connector rather than the 110 V type connector. Otherwise the same terminal structures (fused end, etc.) are preferably used. The thermal coupling (fuse/breaker) of the lasso device may be incorporated into either the plug portion of the device or the tip end of the device. In either case the coupling may be a re-settable breaker or a replaceable fuse.

Power, ground and the loop conductor security system circuit (triggered with a provided key fob) are all that is required for the system to function as a basic alarm. Additional features that may be optional include two additional wires that provide inputs when wired directly to the vehicle's power lock system. Using a rocker switch or the OEM key fob of the vehicle, the loop conductor security system will enable and activate the alarm. Unlocking (by way of the key fob) deactivates the loop conductor system and the alarm.

The system also features the optional ability to use a wireless SMS to communicate to any number of enrolled and authorized users, notifying them of intrusion, attempted theft, or power supply tampering. Other features of existing vehicle alarm systems such as motion and shock detection may likewise be integrated into the system.

Although the present invention has been described in conjunction with a number of preferred embodiments, those skilled in the art will recognize modifications to these embodiments that still fall within the scope of the present invention. It may be preferable, for example, to include and utilize both connector means in a kit for establishing the loop conductor security system in a number of different circumstances. For example, while the initial connection to the vehicle based components of the system might start with a trailer plug connector, it might be beneficial to have an intermediate "convertor" that provides a standard 110 V female outlet at a distal end to accommodate the use of an off-the-shelf extension cord when needed. Of course other types of plugs and outlets may be used to the same effect, the present system finds benefit in the use of standard connectors such that the user may easily expand on through the use of off the shelf extensions and connectors.

I claim:

1. A loop conductor security alarm system for triggering an alarm upon interruption of an established loop circuit electrical conductor, the system comprising:

a power source;

a controller module, powered by the power source and capable of detecting an interruption in an established loop conductor path;

a standard 110 VAC type female outlet connected to the controller module; and a "lasso" termination loop having a standard 110 VAC type male plug connectable to the female outlet, the termination loop further comprising a single conductor extending in a loop out from and back to the male plug.

2. The system of claim 1 further comprising at least one intermediate extension cord connectable between the female outlet connected to the controller module and the male plug connected to the "lasso" termination loop.

3. The system of claim 1 wherein the "lasso" termination loop further comprises a resettable fusible link to prevent overvoltage damage to the termination loop.

4. The system of claim 1 wherein the system is installed in association with a motor vehicle and the power source comprises the battery of the motor vehicle, and further wherein the controller module is positioned in a generally inaccessible location on the motor vehicle when the motor vehicle is locked.

5. The system of claim 1 wherein the system further comprises a local audible alarm device connected to and driven by the controller module.

6. The system of claim 1 wherein the system further comprises an alarm telemetry transmitter connected to and driven by the controller module, wherein a remote electronic device may receive an alarm signal from the system.

7. The system of claim 2 wherein the at least one intermediate extension cord comprises a standard 110 VAC electrical extension cord having two or three conductors.

8. The system of claim 7 wherein the at least one intermediate extension cord comprises a plurality of standard 110 VAC electrical extensions cords connected end to end between the female outlet connected to the controller module and the male plug connected to the "lasso" termination loop.

* * * * *